United States Patent [19]

Komada

[11] 4,352,240

[45] Oct. 5, 1982

[54] METHOD OF CONNECTING A COAXIAL CABLE TO AN ELECTRICAL CONNECTOR

[76] Inventor: Hitoshi Komada, 28-3, Oaza Saito Aza Shimoiseji Fuso-cho, Niwa-gun, Aichi-ken, Japan

[21] Appl. No.: 171,954

[22] Filed: Jul. 24, 1980

Related U.S. Application Data

[63] Continuation-in-part of Ser. No. 41,298, May 22, 1979, abandoned.

[30] Foreign Application Priority Data

Jun. 13, 1978 [JP] Japan ..... 53-71657

[51] Int. Cl.[3] ..... H01R 43/00

[52] U.S. Cl. ..... 29/854; 174/88 C; 339/100

[58] Field of Search ..... 29/868, 869, 854, 828; 174/78, 88 C, 89, 35 C, 75 C; 339/100, 89 C, 177 R

[56] References Cited

U.S. PATENT DOCUMENTS

| | | | |
|---|---|---|---|
| 3,192,308 | 6/1965 | Van Horssen et al. | 174/75 C X |
| 3,539,709 | 11/1970 | Brancaleone | 174/75 C |
| 3,603,912 | 9/1971 | Kelly | 339/89 C |
| 4,156,554 | 5/1979 | Aujla | 339/177 R |

FOREIGN PATENT DOCUMENTS

| | | | |
|---|---|---|---|
| 1285750 | 1/1962 | France | 339/100 |
| 1393432 | 5/1975 | United Kingdom | 174/75 C |

*Primary Examiner*—Carl E. Hall
*Assistant Examiner*—Carl J. Arbes
*Attorney, Agent, or Firm*—Dennison, Meserole, Pollack & Scheiner

[57] ABSTRACT

Disclosed herein is an electrical connector for a coaxial cable which has in a through-hole for receiving the coaxial cable, a projecting positive terminal axially provided in the center and a plurality of projecting ground terminals axially provided in various radial directions in conformity with radiuses of outer conductors of various standards of coaxial cables. The positive terminal and the ground terminals are insulated from each other. The method comprises the steps of severing an end of the coaxial cable smoothly normal to the longitudinal axis thereof, axially moving the severed end of the coaxial cable into contact with the connector, connecting the positive terminal and the ground terminals of the connector axially with inner and outer conductors exposed on the severed end of the coaxial cable and securing the coaxial cable to the connector.

1 Claim, 18 Drawing Figures

METHOD OF CONNECTING A COAXIAL CABLE TO AN ELECTRICAL CONNECTOR

This application is a continuation-in-part of Ser. No. 41,298, filed May 22, 1979, now abandoned.

BACKGROUND OF THE INVENTION

1. Field of the Invention

The present invention relates to a means for connecting a coaxial cable to wiring appliances such as various types of plugs, jacks and connectors without utilizing solder.

2. Description of the Prior Art

In general, there are various standards of coaxial cables in which the cables and their outer conductors are different in radius size.

In case various standards of coaxial cables are to be connected to varieties of plugs, jacks and connectors (hereinafter represented as "connector"), it is possible to connect different standards of coaxial cables to a connector by utilizing solder. However, when a connector which can be connected with a coaxial cable without utilizing solder or without stripping the insulating covers thereof is used, it is impossible to connect different standards of coaxial cables to a connector, leading to necessity of preparing a connector of which standard is in conformity with that of the coaxial cable.

Further, a coaxial cable is connected to an electric apparatus generally through a connector, and when the connector attached to the coaxial cable is not in conformity in standard with the electric apparatus, the connector should be replaced anew, and the coaxial cable and the electric apparatus will require connectors respectively, leading to an increase in cost of electrical appliances.

SUMMARY OF THE INVENTION

The present invention is contemplated overcoming the aforementioned disadvantages of the prior art.

It is an object of the present invention to provide means for connecting a coaxial cable to a wiring appliance without stripping the insulating covers of the coaxial cable.

It is another object of the present invention to provide means for connecting a coaxial cable to a wiring appliance without utilizing solder.

It is still another object of the present invention to provide means for connecting a coaxial cable to a wiring appliance by which the coaxial cable can be directly connected to a chassis of an electric apparatus utilizing a wiring appliance such as various types of a plug, a jack and a connector to which varieties of standards of a coaxial cable can be connected.

DESCRIPTION OF THE PREFERRED EMBODIMENTS

Figure 1:
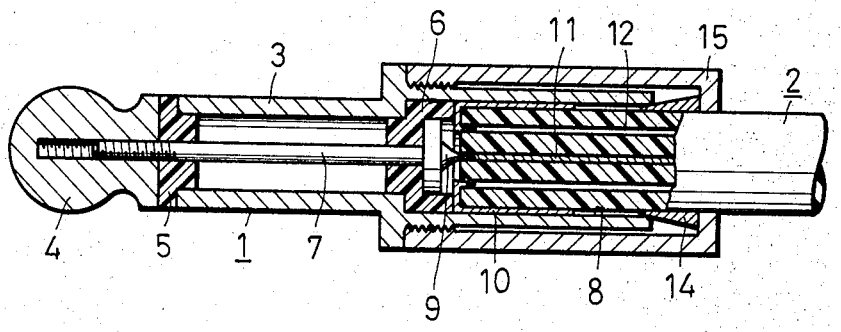
FIG. 1 is a fragmentary side elevational view of a first embodiment of the present invention.
Figure 2:
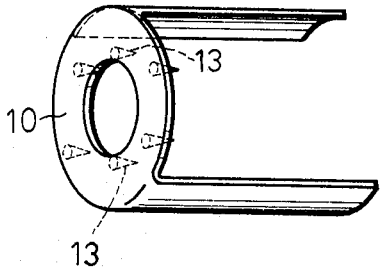
FIG. 2 is an enlarged perspective view of an interconnecting terminal as shown in FIG. 1.
Figure 3:
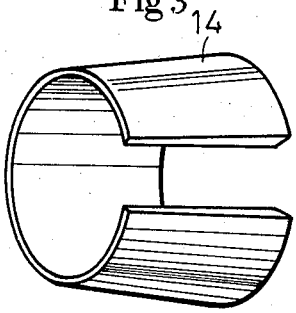
FIG. 3 is an enlarged perspective view of a tapered member as shown in FIG. 1.

Attention is now drawn to FIGS. 1 to 3 of the drawings, in which a first embodiment of the invention is shown. In FIG. 1, numeral 1 indicates a plug to be connected with a coaxial cable 2. The plug 1 comprises a cylindrical member 3 forming a ground electrode and a spherical member 4 forming a positive electrode. The cylindrical member 3 is integrally connected with the spherical member 4 by a clamp bar 7 which is threadedly inserted into the spherical member 4. A pair of insulators 5 and 6 are interposed between the cylindrical member 3 and the spherical member 4 and between the cylindrical member 3 and the clamp bar 7 for insulation purposes. The cylindrical member 3 has in its rear part a through-hole 8 for receiving the coaxial cable 2, into which a pin-shaped plus terminal 9 is projected from the clamp bar 7. An interconnecting terminal 10 forming a ground electrode is inserted in the through-hole 8 to contact the inner wall thereof. As shown in FIG. 2, the interconnecting terminal 10 has a plurality of ground terminals 13 inwardly protruding in various radial directions around the positive terminal 9, i.e., the radial directions of an outer conductor 12 of the cable 2 concentrically enclosing an inner conductor 11.

It is to be noted that the ground terminals 13 as shown in FIG. 1 are provided on the smallest radius of the interconnecting terminal 10 and projected into the outer conductor 12. The other earth terminals are hidden by inner and outer insulating materials. The number of the ground terminals 13 are not limited.

In operation, an end of the coaxial cable 2 is severed perpendicularly to the axis thereof, and inserted under pressure into the through-hole 8. In this condition, the positive terminal 9 is inserted in the inner conductor 11 of the cable 2 and the ground terminals 13 are inserted in the outer conductor 12 to connect the inner and outer conductors 11 and 12 with the spherical member 4 and the cylindrical member 3 respectively. In this case, even if the coaxial cable 2 is different in radius from the plug 1, the ground terminals 13 are securely connected with the outer conductor 12 since the ground terminals 13 positioned on the radius corresponding to that of the outer conductor 12 are projected thereinto. Thereafter a cylindrical case 15 forming a grip is threadedly connected to the cylindrical member 3 through a tapered member 14 which is C-shaped in section as shown in FIG. 3 so that the tapered member 14 is contracted to press against the coaxial cable 2, to secure the coaxial cable 2 to the cylindrical member 3 of the plug 1 and thereby assure connection of the inner and outer conductors 11 and 12 with the spherical member 4 and the cylindrical member 3.

Figure 4:
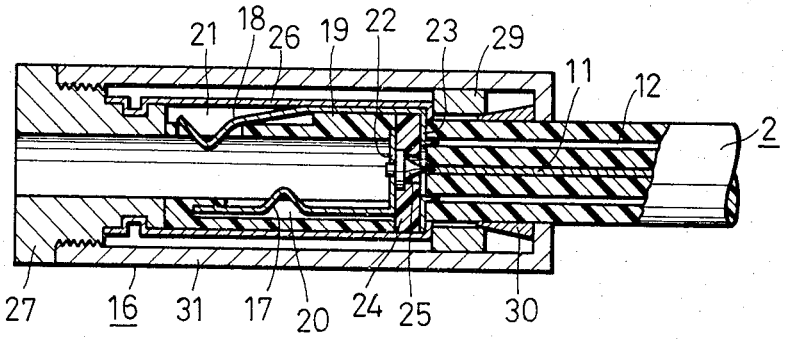
FIG. 4 is a fragmentary side elevational view of a second embodiment of the present invention.
Figure 5:
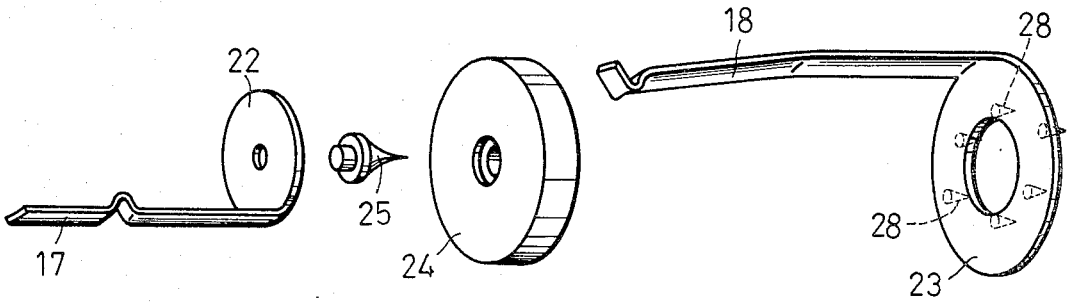
FIG. 5 is an enlarged exploded perspective view of a plus lead plate, an earth lead plate and an insulator as shown in FIG. 4.

In a second embodiment as shown in FIGS. 4 and 5, the coaxial cable 2 is connected with a jack 16 having a positive lead plate 17 forming a positive electrode and a ground lead plate 18 forming a ground electrode, which are, respectively, engaged in an inner groove 20 and an outer groove 21 of an inner cylinder 19 made of insulating material. An insulator 24 and a pin-shaped plus terminal 25 are interposed between bent portions 22 and 23 of the lead plates 17 and 18, which are inserted in an outer cylinder 26 calked by a base 27 for receiving a plug.

In this condition, the positive terminal 25 contacting the positive lead plate 17 is projected through the center of the insulator 24 defining the end surface of the outer cylinder 26, and a plurality of earth terminals 28 protrude integrally from the ground lead plate 18 in various radial directions around the center thereof, i.e., the radial directions of the outer conductor 12 of the cable 2 concentrically enclosing the inner conductor 11.

In operation, an end of the coaxial cable 2 is severed perpendicularly to the axis thereof, and put into contact with the insulator 24. In this condition, the positive terminal 25 is inserted in the inner conductor 11 of the cable 2 and the ground terminals 28 are inserted in the outer conductor 12 to connect the inner and outer conductors 11 and 12 with the positive lead plate 17 and the ground lead plate 18 respectively. Thereafter a cylindrical case 31 forming a grip is threadedly connected to the base 27 through a ring 29 and a tapered member 30 which is C-shaped in section so that the tapered member is contracted to press against the coaxial cable 2 to prevent the coaxial cable 2 from moving in the axial direction thereof, and thereby assure connection of the inner and outer conductors 11 and 12 with the positive lead plate 17 and the ground lead plate 18.

Figure 6:
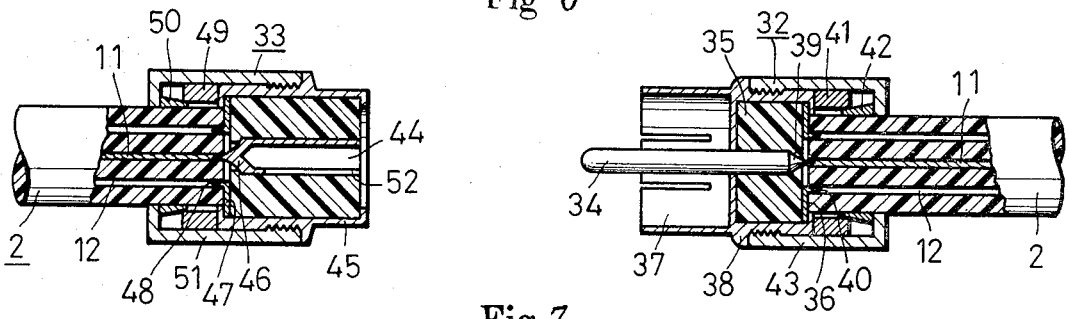
FIG. 6 is a fragmentary side elevational view of a third embodiment of the present invention.

FIG. 6 shows a third embodiment of the present invention in which the cable 2 is connected with an RCA-type plug 32 and a jack 33. An insulator 35 into which a positive electrode bar 34 of the plug 32 is inserted under pressure and an earth electrode plate 36 are calked by a cylinder 38 forming a ground electrode which is integral with a socket 37. In this condition, a pin-shaped plus terminal 39 formed integrally with the electrode bar 34 and insulated from the cylinder 38 and the electrode plate 36 and a pair of ground terminals 40 formed integrally with the electrode plate 36 contacting the cylinder 38 protrude outwardly from the insulator 35.

In operation, a perpendicularly severed end of the coaxial cable 2 is put into contact with the electrode plate 36 under pressure to get the positive terminal 39 and the ground terminals 40 inserted in the inner and outer conductors 11 and 12 respectively and thereby connect the inner and outer conductors 11 and 12 with the plus electrode bar 34 and the socket 37 forming the ground electrode respectively. Thereafter a cylindrical case 43 forming a grip is threadedly connected to the cylinder 38 through a ring 41 and a tapered member 42 which is C-shaped in section to prevent the coaxial cable 2 from moving in the axial direction thereof, and thereby assure connection of the inner and outer conductors 11 and 12 with the electrode bar 34 and the socket 37 respectively.

In a similar manner, an electrode holder 44 for a positive electrode and a cylinder 45 forming a ground electrode constituting the jack 33 are respectively connected with the inner and outer conductors 11 and 12 through a positive terminal 46 formed integrally with the electrode holder 44 and a pair of ground terminals 48 formed integrally with an electrode plate 47 contacting the cylinder 45. To assure the connection, the coaxial cable 2 is secured to the cylinder 45 by a ring 49, a tapered member 50 which is C-shaped in section and a cylindrical case 51 forming a grip.

In FIG. 6, numeral 52 indicates a slit for purging air from the electrode holder 44 when the electrode bar 34 is inserted thereinto.

Figure 7:
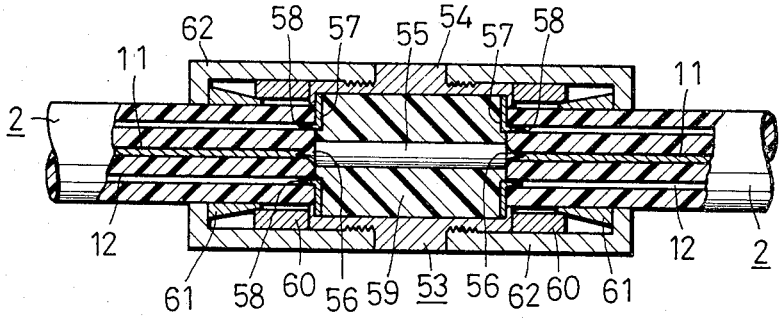
FIG. 7 is a fragmentary side elevational view of a fourth embodiment of the present invention.

FIG. 7 shows a fourth embodiment of the present invention in which two coaxial cables 2 are connected with each other through a connector 53. A pair of positive terminals 56 formed on both ends of a plus electrode bar 55 and two pairs of ground terminals 58 formed on both ends of a ground electrode plate 57 and insulated from the positive terminals 56 by an insulator 59 protrude from both ends of a cylinder 54 forming a ground electrode. The inner conductors 11 and the outer conductors 12 of the coaxial cables 2 are respectively connected with the positive terminals 56 and the ground terminals 58 under pressure, and the cables 2 are secured to the cylinder 54 by rings 60, tapered members 61 which are C-shaped in section and cylindrical cases 62 forming grips. The construction, function and effect of this embodiment are substantially identical with those of the third embodiment is shown in FIG. 6.

Figure 8:
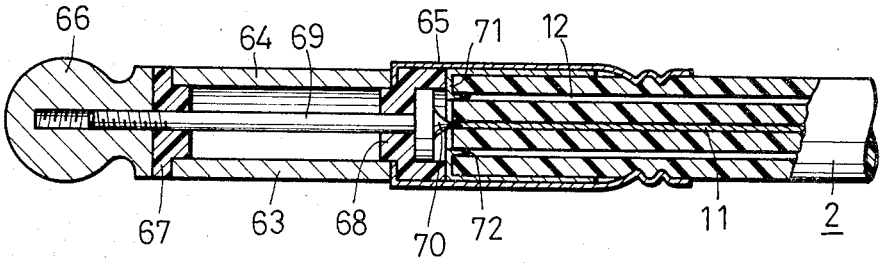
FIG. 8 is a fragmentary side elevational view of a fifth embodiment of the present invention.

FIG. 8 shows a fifth embodiment of the present invention in which the coaxial cable 2 is connected with a plug 63. The plug 63 comprises a cylindrical member 64 forming a ground electrode, a cylindrical case 65 forming a grip and a spherical member 66 forming a positive electrode. The three elements are integrally connected with one another by a clamp bar 69 forming a positive electrode which is threadedly inserted into the spherical member 66 with interposition of a pair of insulators 67 and 68 for insulation purposes. The inner and outer conductors 11 and 12 of the cable 2 are put into contact with a plus terminal 70 formed in an end of the clamp bar 69 and a pair of ground terminals 72 formed integrally with a ground electrode plate 71 inserted in the case 65 respectively, and the rear part of the case 65 is clamped against the cable 2 to assure connection of the cable 2 and the plug 63. The construction, function and effect of this embodiment are substantially identical with those of the first embodiment.

In each of the aforementioned embodiments of the present invention, each conductor can be bonded to each terminal while maintaining fitting of the conductor and the terminal by discharging electricity such as condenser energy therebetween.

Figure 9:
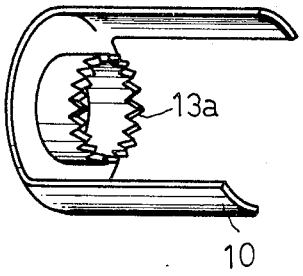
FIGS. 9 to 11 are enlarged perspective views showing modifications of the earth electrode.
Figure 10:
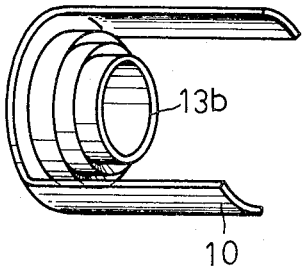
Figure 11:
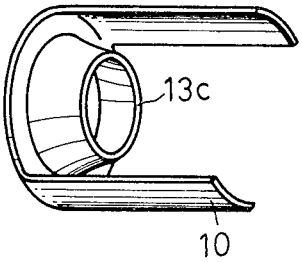

Attention is now drawn to FIGS. 9 to 11 in which modifications in the shape of the ground terminal are shown.

In a sixth embodiment as shown in FIG. 9, a circular ground terminal 13*a* having a saw-toothed forward end is formed by extrusion molding eccentrically from the center of the interconnecting terminal 10. When the coaxial cable is pressed against the ground terminal 13*a*, the ground terminal 13*a* bites into the coaxial cable so that it is securely connected with the outer conductor of the coaxial cable upon contact thereof regardless of the standard of the coaxial cable.

In a seventh embodiment as shown in FIG. 10, the interconnecting terminal 10 is provided with a plurality of coaxial cylindrical ground terminals 13*b* which are different in height and in radius so as to be adapted to the outer conductors of various standards of coaxial cables. When the coaxial cable is pressed against the interconnecting terminal 10, the ground terminal 13*b* having a radius corresponding to that of the outer conductor bites thereinto to be securely connected wih the coaxial cable.

In an eighth embodiment as shown in FIG. 11, the interconnecting terminal 10 has a frustroconical earth terminal 13*c* which is formed by extrusion molding. When the coaxial cable smoothly severed perpendicularly to its axis is pressed against the ground terminal 13*c*, the inner insulating material is pushed inwardly into the coaxial cable to expose the outer conductor, which becomes in contact with the ground terminal 13*c* and is connected thereto.

The ground terminals of the sixth to eighth embodiment are to be applied to the aforementioned first to fifth embodiments respectively.

According to the present invention, the coaxial cable can be directly connected to a chassis of an electric apparatus as hereinafter described.

Figure 12:
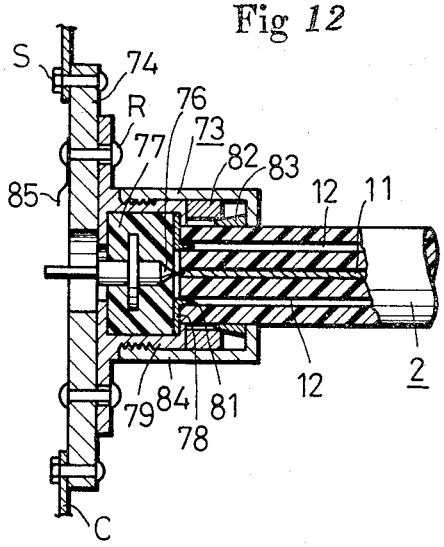
FIG. 12 is a fragmentary side elevational view of a ninth embodiment of the present invention.

In FIG. 12, there is shown a chassis C of an electric apparatus to which an insulating plate 74 is secured by a screw S, and a connector 73 is secured to the insulating plate 74 by a rivet R. A lag 85 functioning as a negative electrode is mounted to the screw S to be connected with the body of the connector 73 therethrough. Numeral 80 indicates a positive electrode which is integral with a pin-shaped plus terminal 76.

An insulator 77 containing the pin-shaped plus terminal 76 of the connector 73 and a pole plate 78 are calked in a cylindrical body 79 of a ground electrode. In this condition, the pin-shaped positive terminal 76 integrally formed with the positive electrode 80 while insulated from the cylindrical body 79 and the pole plate 78 and a ground terminal 81 integrally formed with the pole plate 78 which is in contact with the cylindrical body 79 by calking protrude backwardly from the insulator 77.

When a coaxial cable 2 of which end is severed perpendicularly to its axis is pressed against the pole plate 78, the positive terminal 76 and the ground terminal 81 are projected into inner and outer conductors 11 and 12 respectively.

Then a cylindrical case 84 forming a grip is threadedly connected to the cylindrical body 79 through a ring 82 and a C-shaped tapered member 83 so that the coaxial cable 2 is prevented from moving in the axial direction and the inner and outer conductors 11 and 12 are securely connected with the positive electrode 80 and the lag 85 respectively.

Figure 13:
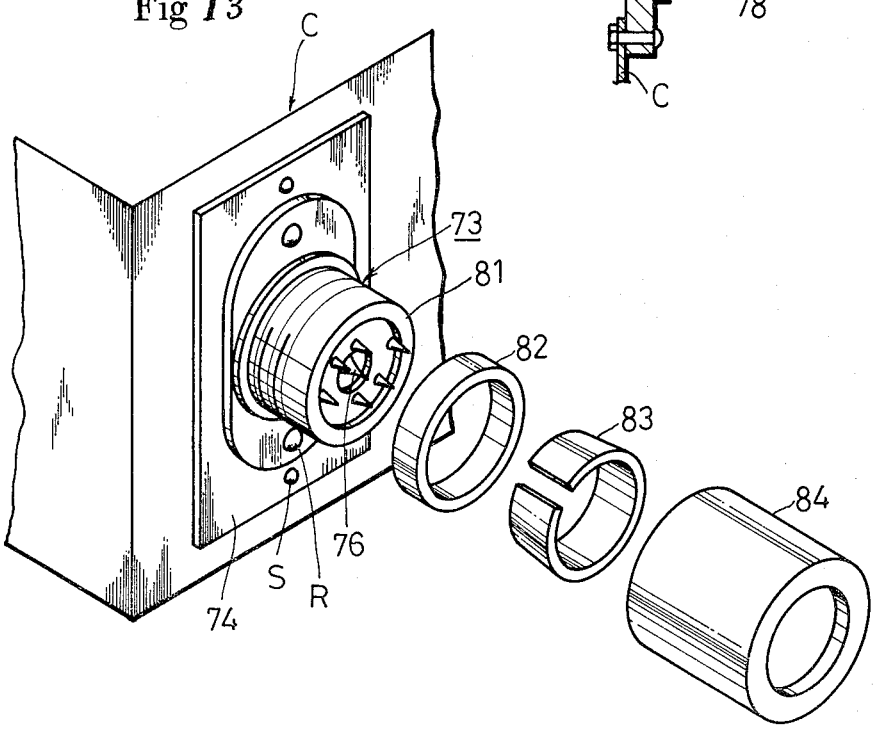
FIG. 13 is an exploded perspective view of the embodiment of FIG. 12.

In FIG. 13, the coaxial cable 2 is detached from the chassis C. In this condition, the cylindrical case 84, the ring 82 and the C-shaped tapered member 83 are to be removed. In this embodiment, the ground terminal may be selected from the aforementioned sixth to eighth embodiments.

Figure 14:
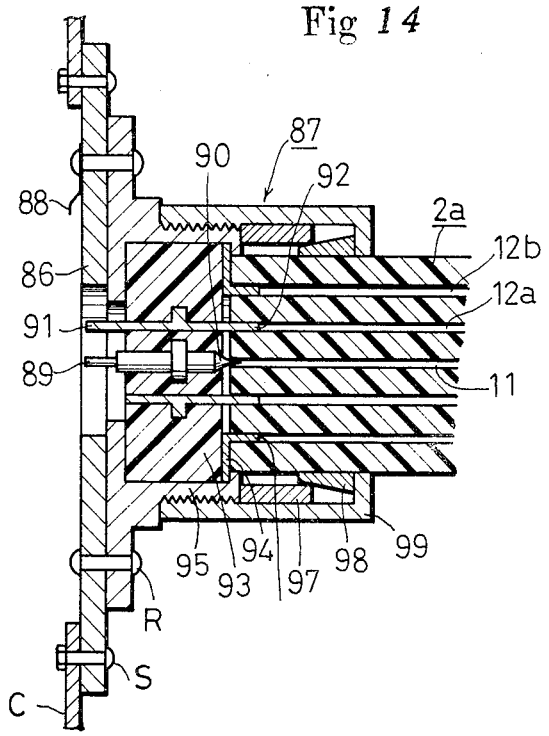
FIG. 14 is a fragmentary side elevational view of a tenth embodiment of the present invention.

In FIG. 14, there is shown a modification applied to a coaxial cable having double or more outer conductors.

An insulating plate 86 is secured to a chassis C of an electric apparatus by a screw S, and a connector 87 is secured to the insulating plate 86 by a rivet R. A lag 88 functioning as a negative electrode is mounted to the screw S to be connected with the body of the connector 87 therethrough. Numeral 89 indicates a first positive electrode which is integral with a first plus terminal 90. A second positive electrode 91 is integrally formed with a second plus terminal 92.

An insulator 93 containing the first and second positive terminals 90 and 92 of the connector 87 and a pole plate 94 are calked in a cylindrical body 79 of a ground electrode. In this condition, the first and second positive terminals 90 and 92 integrally formed with the first and second positive electrodes 89 and 91 while insulated from the cylindrical body 95 and the pole plate 94 and a ground terminal 96 integrally formed with the pole plate 94 which is in contact with the cylindrical body 95 by calking protrude backwardly from the insulator 93.

When a coaxial cable 2*a* of which end is severed perpendicularly to its axis is pressed against the pole plate 94, the first positive terminal 90, the second positive terminal 92 and the ground terminal 96 are projected into an inner conductor 11, a first outer conductor 12*a* and a second outer conductor 12*b* of the coaxial cable 2*a* respectively.

Then a cylindrical case 99 forming a grip is threadedly connected to the cylindrical body 95 through a ring 97 and a C-shaped tapered member 98 so that the coaxial cable 2*a* is prevented from moving in the axial direction and the inner conductor 11 and the first and second outer conductors 12*a* and 12*b* are securely connected with the first and second positive electrodes 89 and 91 and the lag 88 respectively.

Figure 15:
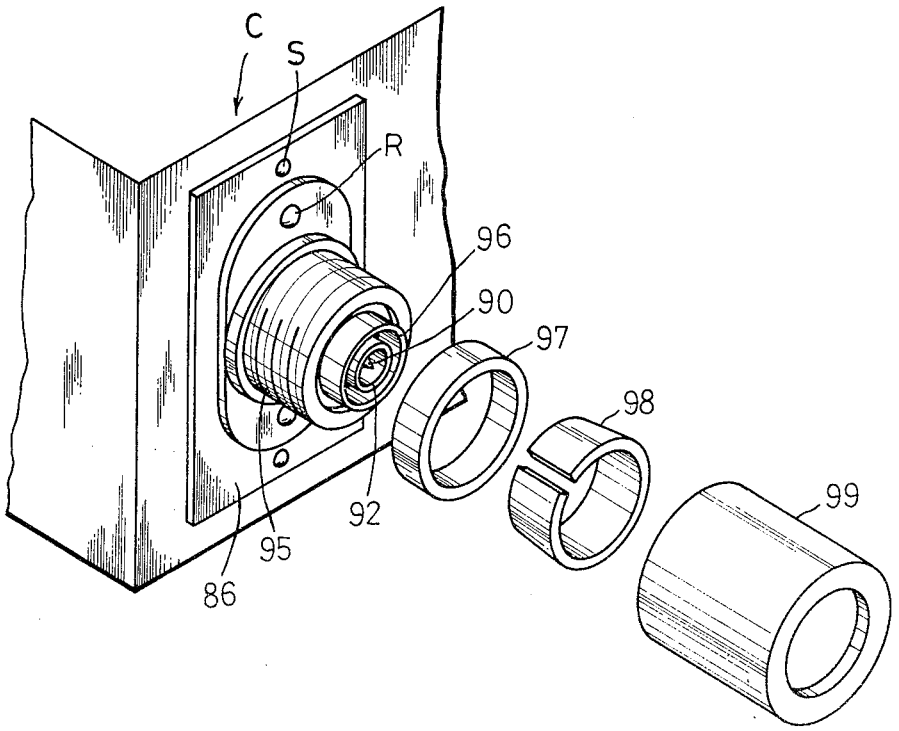
FIG. 15 is an exploded perspective view of the embodiment of FIG. 14.

In FIG. 15, the coaxial cable 2*a* is detached from the chassis C. In this condition, the cylindrical case 99, the ring 97 and the C-shaped tapered member 98 are to be removed.

Figure 16:
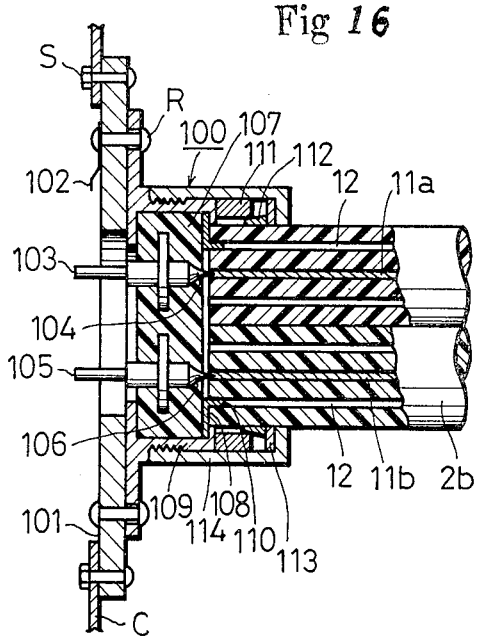
FIG. 16 is a fragmentary side elevational view of an eleventh embodiment of the present invention.

In FIG. 16, there is shown a connector 100 for a coaxial cable assembly 2*b* consisting of a pair of coaxial cables which are secured in parallel with each other. The connector 100 functions to connect the coaxial cable assembly 2*b* directly with a chassis of an electric apparatus.

An insulating plate 101 is secured to a chassis C of an electric apparatus by a screw S, and a connector 100 is secured to the insulating plate 101 by a rivet R. A lag 102 functioning as a negative electrode is mounted to the screw S to be connected with the body of the connector 100 therethrough. Numeral 103 indicates a first positive electrode which is integral with a first positive terminal 104. A second positive electrode 105 is integrally formed with a second positive terminal 106.

An insulator 107 containing the first and second positive terminals 104 and 106 of the connector 100 and a pole plate 108 are calked in a cylindrical body 109 of a ground electrode. In this condition, the first and second positive terminals 104 and 106 integrally formed with the first and second positive electrodes 103 and 105 while insulated from the cylindrical body 109 and the pole plate 108 and a ground terminal 110 integrally formed with the pole plate 108 which is in contact with the cylindrical body 109 by calking protrude backwardly from the insulator 107.

When the coaxial cable assembly 2*b* of which end is severed perpendicularly to its axis is pressed against the pole plate 108, the first positive terminal 104, the second plus terminal 106 and the ground terminal 110 are projected into a first inner conductor 11*a*, a second inner conductor 11*b* and an outer conductor 12 of the coaxial cable assembly 2*b* respectively.

Then a cylindrical case 114 forming a grip is threadedly connected to the cylindrical body 109 through a ring 111, a tapered member 112 and a set member 113 for the tapered member 112 so that the coaxial cable assembly 2*b* is prevented from moving in the axial direction and the first and second inner conductors 11*a* and 11*b* and the outer conductor 12 are securely connected with the first and second positive electrodes 103 and 105 and the lag 102 respectively.

Figure 17:
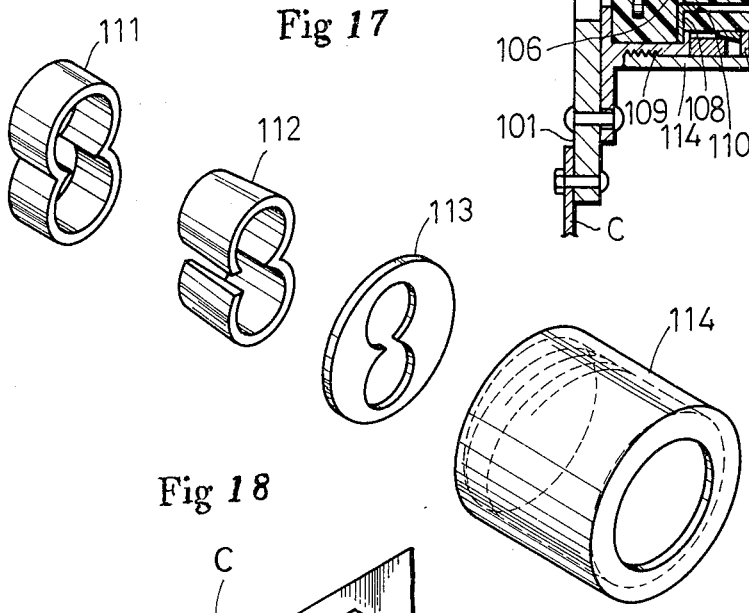
FIG. 17 is an exploded perspective view of a part of FIG. 16.
Figure 18:
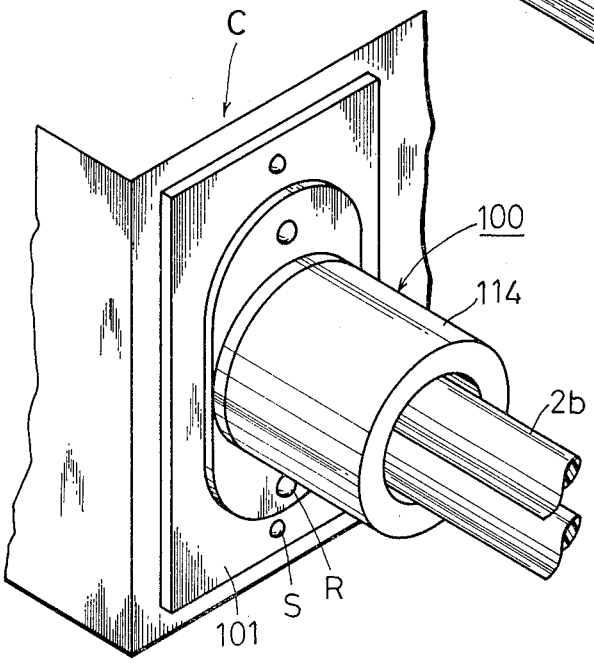
FIG. 18 is a perspective view of the embodiment of FIG. 16.

FIG. 17 is an exploded perspective view showing the shapes of the ring 111, the tapered member 112, the set member 113 and the cylindrical case 114. FIG. 18 is a perspective view in which the coaxial cable assembly 2*b* is connected to the connector 100.

While the invention has been described with reference to some preferred embodiments thereof, it is to be understood that modifications or variations may be easily made without departing from the scope of this invention which is defined by the appended claims.

What is claimed is:

1. A method of electrically and mechanically connecting a coaxial cable having a central positive conductor and a circumferential ground shield radially spaced and insulated therefrom to an electrical connector having an axial bore for receiving said coaxial cable, a projecting positive terminal axially provided in the center and a plurality of ground terminals projecting axially opposite said positive terminal and spaced radially therefrom in conformity with radiuses of a plurality of concentric ground conductors in the cable of various standards of cable, said positive terminal and said ground terminals being insulated from each other, said method comprising the steps of:

severing an end of said coaxial cable smoothly normal to the longitudinal axis thereof exposing only the end faces of said terminal and ground conductors;

axially moving said severed end of said coaxial cable into contact with said electrical connector;

connecting said positive terminal and said ground terminals of said wiring appliance axially with the central and ground conductors respectively exposed on said severed end of said coaxial cable;

and securing said coaxial cable to said electrical connector.

* * * * *